US009363877B2

(12) United States Patent
Graham

(10) Patent No.: US 9,363,877 B2
(45) Date of Patent: Jun. 7, 2016

(54) SYSTEM AND METHOD TO REDUCE OSCILLATIONS IN EXTREME ULTRAVIOLET LIGHT GENERATION

(71) Applicant: ASML Netherlands B.V., Veldhoven (NL)

(72) Inventor: Matthew Graham, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/454,565

(22) Filed: Aug. 7, 2014

(65) Prior Publication Data

US 2016/0044772 A1 Feb. 11, 2016

(51) Int. Cl.
*H05G 2/00* (2006.01)

(52) U.S. Cl.
CPC ..... *H05G 2/006* (2013.01); *H05G 2/008* (2013.01)

(58) Field of Classification Search
CPC ..... H05G 2/006; H05G 2/008
USPC ..... 250/504 R
See application file for complete search history.

(56) References Cited

U.S. PATENT DOCUMENTS 5,340,090 A 8/1994 Orme et al.
2012/0228526 A1* 9/2012 Vaschenko ..... 250/504 R
2013/0234051 A1 9/2013 Rajyaguru et al.
2014/0042343 A1 2/2014 Vaschenko
2014/0191132 A1 7/2014 Schafgans et al.
2014/0246607 A1* 9/2014 Bykanov et al. ..... 250/504 R

FOREIGN PATENT DOCUMENTS

WO 2014120985 A1 8/2014

OTHER PUBLICATIONS

Agilent Technologies, Inc., "Agilent 33220A 20 MHz Function/Arbitrary Waveform Generator", (user's manual), Mar. 2005, [online], [retrieved on Sep. 16, 2015]. Retrieved from the Internet: <URL: https;//www.eecs.umich.edu/eecs/fabsupport/pdfs;33220-900002.pdf>; p. 54, paragraph 1.

* cited by examiner

*Primary Examiner* — Jack Berman
*Assistant Examiner* — Eliza Osenbaugh-Stewar
(74) *Attorney, Agent, or Firm* — Gard & Kaslow LLP

(57) ABSTRACT

A droplet generation system for use with a laser produced plasma (LPP) extreme ultraviolet (EUV) source plasma chamber is described. During EUV generation, oscillations can occur as a function of droplet time-of-flight within the plasma chamber. To reduce these oscillations, a droplet controller adjusts the rate at which droplets are generated which, in turn, dictates the droplet time-of-flight. The droplets are a result of coalescence of generated microdroplets such that the rate at which the droplets are generated is dictated by a frequency of a signal used to generate the microdroplets. This adjustment can be a modulation of a baseline droplet frequency. In some instances, the modulation function may be a sinusoid or implemented as a pseudo-random switch.

20 Claims, 5 Drawing Sheets

300

SYSTEM AND METHOD TO REDUCE OSCILLATIONS IN EXTREME ULTRAVIOLET LIGHT GENERATION

BACKGROUND

1. Field

This disclosure relates generally to reduction of oscillations occurring during extreme ultraviolet light generation and more particularly to droplet generation.

2. Description of Related Art

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of between 10 and 110 nm. EUV lithography is generally considered to include EUV light at wavelengths in the range of 10-14 nm, and is used to produce extremely small features (e.g., sub-32 nm features) in substrates such as silicon wafers. These systems must be highly reliable and provide cost-effective throughput and reasonable process latitude.

Methods to generate EUV light include, but are not necessarily limited to, converting a material into a plasma state that has one or more elements (e.g., xenon, lithium, tin, indium, antimony, tellurium, aluminum, etc.) with one or more emission line(s) in the EUV range. In one such method, often termed laser-produced plasma ("LPP"), the required plasma can be generated by irradiating a target material, such as a droplet, stream or cluster of material having the desired line-emitting element, with a laser beam at an irradiation site within an LPP EUV source plasma chamber.

When operating an EUV light source in a firing pattern having bursts lasting 1 ms or longer than super-pulse 1 ms, the resulting EUV energy is subject to sudden-onset oscillations. These oscillations occur at deterministic frequencies that are a function of the droplet time-of-flight and other parameters of the LPP EUV system (e.g., pressure and surrounding gas flow velocity) from a nozzle to an irradiation site in the plasma chamber. Current LPP EUV systems actively compensate for the oscillations by actuating source laser amplitude or by actuating timing of a source laser.

SUMMARY

In one embodiment, a system comprises: a droplet controller configured to adjust, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at an irradiation site within a laser produced plasma (LPP) extreme ultraviolet (EUV) source plasma chamber; and a droplet generator configured to generate the microdroplets according to the adjusted frequency of the microdroplet generation function.

In another embodiment, a method comprises: adjusting, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at an irradiation site within a laser produced plasma (LPP) extreme ultraviolet (EUV) source plasma chamber; and generating the microdroplets according to the adjusted amplitude of the microdroplet generation function.

In a further embodiment, a non-transitory computer-readable medium has instructions embodied thereon, the instructions, when executed by one or more processor, perform operations comprising: adjusting, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at an irradiation site within a laser produced plasma (LPP) extreme ultraviolet (EUV) source plasma chamber; and generating the microdroplets according to the adjusted frequency of the microdroplet generation function.

DETAILED DESCRIPTION

In EUV systems, oscillations in energy occur as a function of a number of variables including droplet time-of-flight from a droplet source to an irradiation site within a plasma chamber. These oscillations can occur when the droplets are generated at a fixed frequency in a continuous flow. To reduce the oscillations, the frequency at which the droplets are generated is modulated around the fixed frequency (referred to as a baseline frequency).

While, in some instances, a dose controller with knowledge of frequency changes can immediately compensate or offset for a next droplet, zero-mean modulation can be used to minimize the effects of the modulation on the EUV light emitted from the EUV light source. In zero-mean modulation, the baseline frequency of the droplets is modulated in such a way as to have a zero-mean over a period of time. A dose window of the EUV light source is used to determine the period of time over which the modulation function is defined. The zero-mean modulation may be achieved using a variety of functions including a sinusoidal function and by switching the droplet frequency at random times between frequencies.

The droplets are coalesced from microdroplets. The microdroplets, in turn, are generated according to another function. In current EUV systems, the function used to create the microdroplets generates coalesced droplets at a fixed frequency by virtue of having a fixed amplitude. In the EUV system described herein, the microdroplets are generated according to a sinusoidal or step function having a varying frequency which results in a modulation of the frequency of the droplets coalesced from the microdroplets.

To synchronize the laser pulses with the droplets in the plasma chamber, the modulation function is fed forward to the dose controller and components used to control timing of the source laser. Further, the modulation may be adjusted based on data collected from the plasma chamber. The data may indicate a measured frequency of droplets or EUV power generated.

Figure 1:
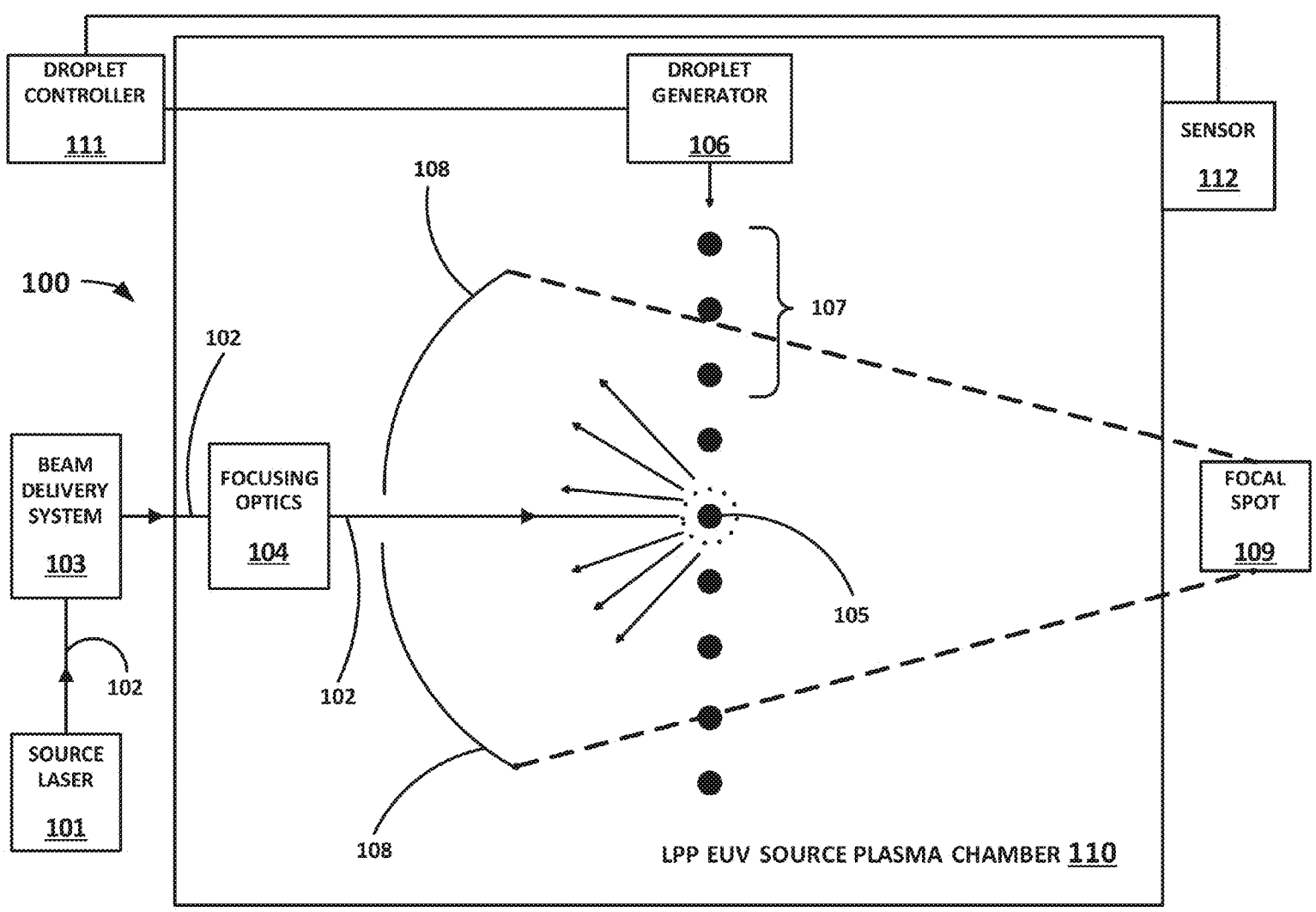
FIG. 1 is a schematic illustrating some of the components of an LPP EUV system according to an embodiment.

FIG. 1 illustrates some of the components of an LPP EUV system 100 according to an embodiment. A source laser 101, such as a $CO_2$ laser, produces a laser beam 102 that passes through a beam delivery system 103 and through focusing optics 104 (comprising a lens and a steering mirror). Focusing optics 104 have a primary focal spot at an irradiation site 105 within an LPP EUV source plasma chamber 110. A droplet controller 111 controls droplet generator 106 that produces microdroplets which coalesce into droplets 107 of an appropriate target material that, when hit by laser beam 102 at the irradiation site 105, generate a plasma which irradiates EUV light. A sensor 112 may measure the frequency of the droplets 107 or an energy from the generated plasma. An elliptical mirror ("collector") 108 focuses the EUV light from the plasma at a focal spot 109 (also known as an intermediate focus position) for delivering the generated EUV light to, e.g., a lithography scanner system (not shown). Focal spot 109 will typically be within a scanner (not shown) containing wafers that are to be exposed to the EUV light. In some embodiments, there may be multiple source lasers 101, with beams that all coverage on focusing optics 104. One type of LPP EUV light source may use a $CO_2$ laser and a zinc selenide (ZnSe) lens with an anti-reflective coating and a clear aperture of about 6 to 8 inches.

Figure 2:
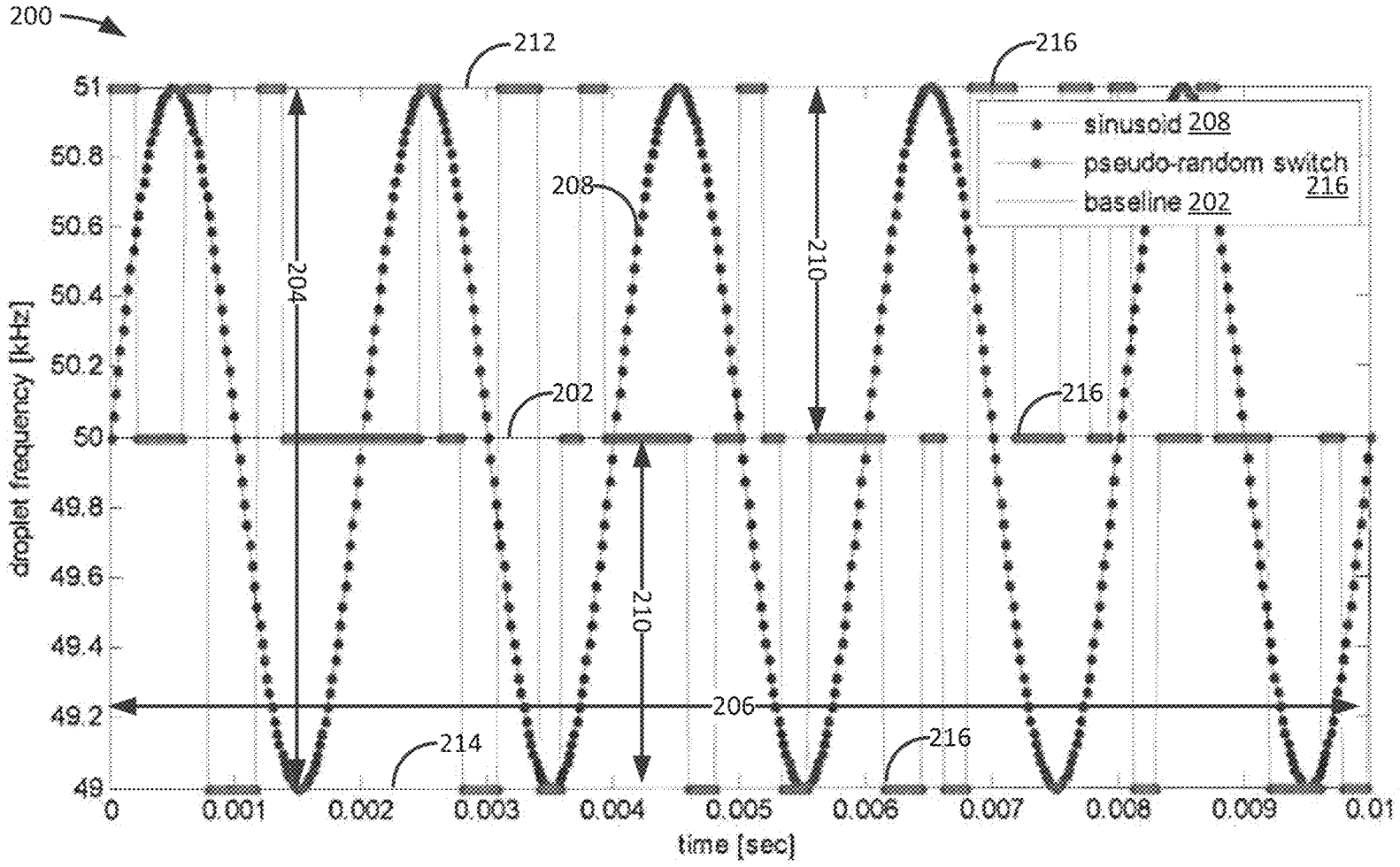
FIG. 2 is a graph depicting droplet generation frequency as a function of time.

FIG. 2 is a graph 200 depicting droplet generation frequency as a function of time. The graph depicts two possible modulation functions that may be applied at a baseline frequency 202 of 50 kHz. In each modulation function, a droplet frequency varies within a tunable range 204 over a time scale 206 (e.g., duration) of the modulation function. As would be apparent to those skilled in the art based on this disclosure, the tunable range 204 is bound by a coalescence distance of the droplets. As depicted, the tunable range 204 of the modulation function is between 49 kHz and 51 kHz, and the time scale 206 of the modulation functions shown is 0.01 seconds.

The modulation function may be generated and stored as a separate function from the baseline frequency 202. During operation, the modulation function and the baseline frequency are then combined to instruct the droplet generator 106 to produce droplets at a modulated frequency. In other embodiments, the modulation function may itself express the baseline frequency 202 as, for example, an offset to the modulation function.

A depicted sinusoid modulation function 208 repeats five times during the time scale 206 (i.e., every 0.002 seconds) with a modulation amplitude 210 of 1 Hz. The sinusoid modulation function 208 starts at the baseline frequency 202 of 50 kHz, reaches a maximum frequency 212 of 51 kHz and a minimum frequency 214 of 49 kHz. By virtue of being a sine wave, the sinusoid modulation function 208 has a zero-mean amplitude over each repeated cycle.

A depicted second modulation function 216 (labeled "pseudo-random switch") is a randomly-timed, fixed-amplitude perturbation. This perturbation is implemented as a switch that switches between the baseline frequency 202 of 50 kHz, the maximum frequency 212 in the tunable range 204 of 51 kHz, and the minimum frequency 214 of the tunable range 204 of 49 kHz. The timing of the switching during the time scale 206 is randomly calculated but constrained so as to have a zero-mean amplitude over the time scale 206.

The various frequencies discussed with respect to FIG. 2 are achieved by adjusting a function that controls the droplet generator 106. Examples of functions that can be used include, but are not limited to, amplitude modulation, frequency modulation, a sawtooth function, a sinc function, a pulsewave (e.g., a rectangular waveform), and a bipolar pulse wave. As explained elsewhere, the amplitude of the function changes the force with which a piezoelectric transducer (PZT) in the droplet generator 106 pushes out the microdroplets that coalesce into the droplets. In some instances, the amplitude of the function is directly proportional to the resulting droplet frequency.

Figure 3:
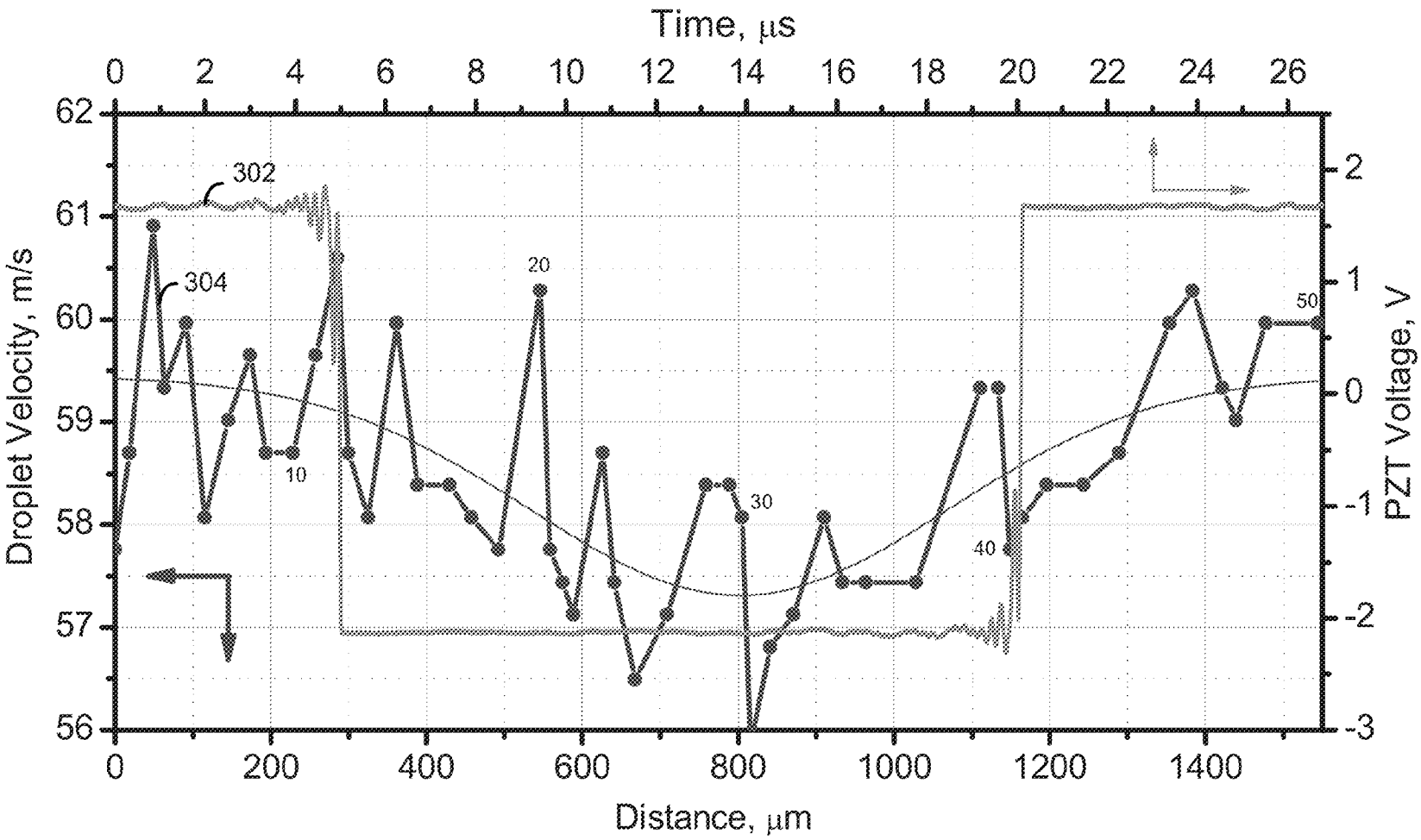
FIG. 3 is a graph depicting the relationship between voltage applied to a droplet generator and microdroplet generation.

FIG. 3 is a graph 300 depicting the microdroplet input stream as a function of voltage applied to the PZT. To effectively cause changes in the coalescence of the microdroplets into droplets according to a modulation function, a large velocity gradient between the microdroplets themselves is generated (e.g., approximately 37.5 (m/s)/mm). The velocity of the microdroplets is controlled by pressure modulation in the droplet generator 106 caused by significant capillary deformation when a voltage is applied to the PZT and by exploiting the surface tension effect by varying timing of droplet break-off from a continuous jet.

The graph 300 depicts an example of the relationship between a voltage applied to the PZT over time (curve 302, right and top axes) and droplet velocity over distance (curve 304, left and bottom axes). As is apparent from this graph to those skilled in the art, as the voltage applied to the PZT deforming the capillary changes, the droplet velocity varies about a sinusoidal function. This relationship between voltage and droplet velocity can be exploited using techniques known in the art to cause the microdroplets to coalesce according to a modulation function.

Figure 4:
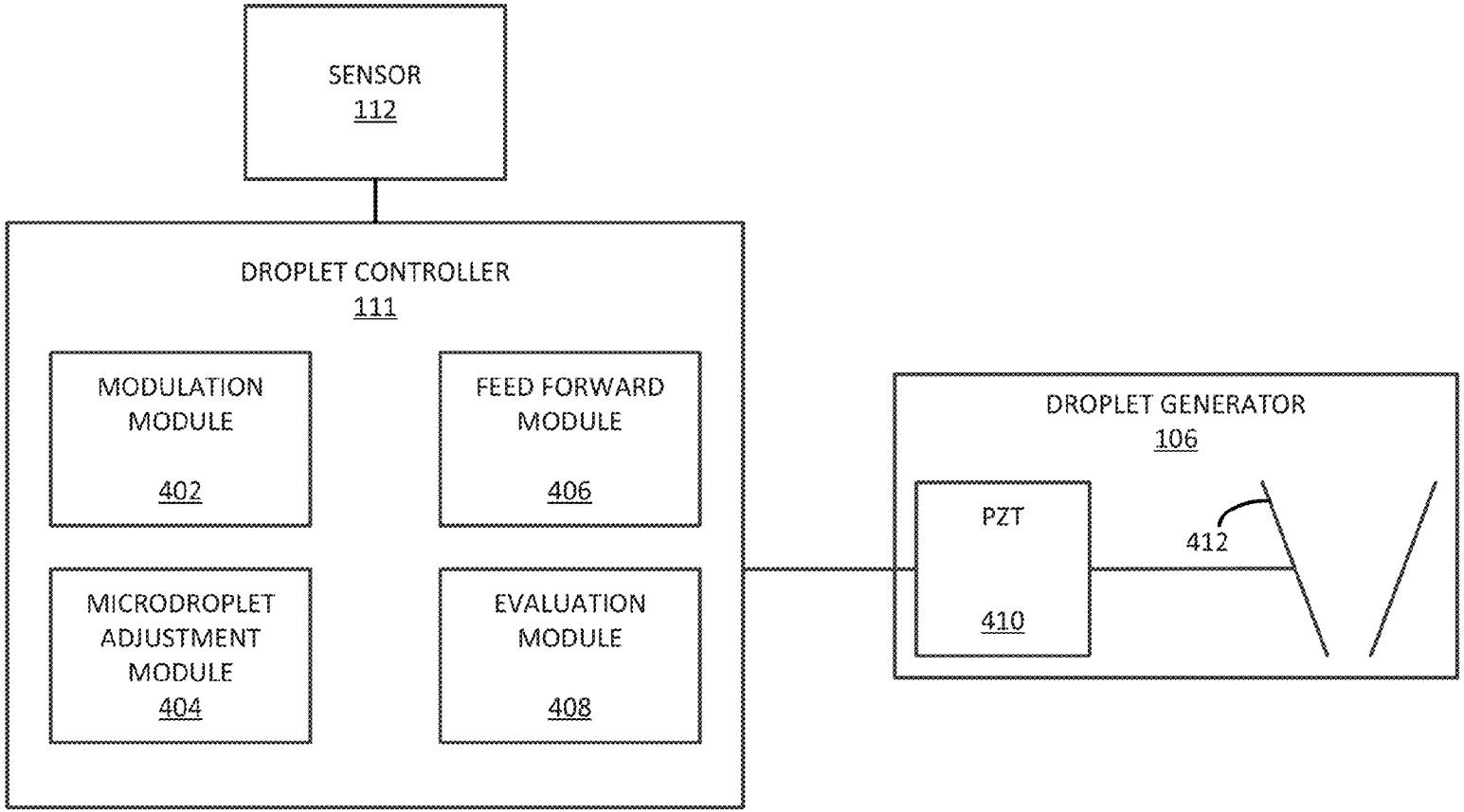
FIG. 4 is a block diagram of a portion of the EUV system components involved in droplet generation.

FIG. 4 is a block diagram of a portion of the EUV system 100 components involved in droplet generation. The EUV system 100 may be implemented in a variety of ways known to those skilled in the art including, but not limited to, as a computer having a processor with access to a memory capable of storing executable instructions. The computer may include one or more input and output components, including components for accessing other computers via a network. In operation, the components shown in FIG. 4 generate microdroplets that coalesce into droplets 107 that, in turn, arrive at the irradiation site 105 within the plasma chamber 110.

Droplet controller 111 obtains a modulation function used to modulate the pre-defined droplet frequency at which the droplets 107 arrive at the irradiation site 105. The pre-defined droplet frequency is the baseline frequency 202 selected based on the power output of the EUV system 100 desired by the scanner. As is known in the art, the pre-defined droplet frequency affects the velocity (at a given pressure and nozzle size) at which the droplets 107 arrive at the irradiation site 105. The resulting droplet frequency is a result of the coalescence of microdroplets and is a function of a number of variables including, but not limited to, a size of the respective microdroplets, a nozzle pressure of a nozzle 412, a number of microdroplets formed over a period of time, and a size of the nozzle 412. In some instances, the pre-defined droplet frequency is 40 kiloHertz (kHz), 50 kHz (as shown in FIG. 2), 60 kHz, or 100 kHz.

The microdroplet adjustment module 404 may obtain the modulation function by either accessing a memory (not shown) at the modulation module 402 or within droplet controller 111 or generating it within the modulation module 402.

The modulation function is defined over the specified time scale 206 that is equal or shorter in duration than a dose window. The dose window is a duration of time during which a moving average of the EUV energy generated in the plasma chamber 110 is measured. In one example, the dose window is 0.01 seconds. The specified time scale 206 of the modulation function may be a fraction of the dose window such that the dose window contains a whole number of time scales. For example, a dose window may be ten times the duration of the specified time scale 206 of the modulation function so that each dose window contains ten whole modulation functions.

The modulation function is further characterized by modulation amplitude 210 measured from the baseline frequency 202. The modulation amplitude 210 is constrained by a defined tunable range 204 that indicates the range of frequencies within which droplets can generated. The tunable range 204 may be manually selected or selected as a function of the baseline frequency 202. In some instances, the tunable range 204 may be limited by the ability of the microdroplets to coalesce near or below the baseline frequency 202. Referring to the modulation functions shown in FIG. 2, if the baseline frequency 202 is 50 kHz, the modulation function may cause the actual frequency of the droplets 107 to vary within a defined tunable range 204 from 49 kHz to 51 kHz. In this example, the modulation function has a modulation amplitude 210 of no more than 1 kHz. In other instances, the modulation amplitude can be greater than or less than 1 kHz.

The modulation function has a zero-mean modulation over the specified time scale 206. The zero-mean modulation is calculated as an average amplitude value of the modulation function over the specified time scale 206. To achieve a zero-mean modulation or to compensate the dose control to deliver an average power during the dose window, a variety of mathematical functions may be used.

In some instances, a sinusoid may be used, such as sinusoid 208. The sinusoid 208 is generated so as to include one or more complete cycles, resulting in a zero-mean amplitude. In some instances, the frequency of the oscillations caused by time-of-flight, and multiples thereof, are avoided. To illustrate, the sinusoid 208 shown in FIG. 2 includes five complete cycles each lasting 0.002 seconds over a 0.01 second time scale. Alternatively, the sinusoid 208 may be characterized by one of skill in the art as having a 0.002 second time scale while preserving its zero-mean modulation.

In other instances, a randomly-timed, fixed-amplitude perturbation is used (e.g., the second modulation function 206 of FIG. 2). The perturbation is implemented as a pseudo-random switch that has a zero-mean constraint over the time scale 206. In these instances, the modulation function 206 pseudo-randomly switches between the baseline frequency, the maximum frequency of the tunable range, and the minimum frequency of the tunable range, though not necessarily in that order. The switch may be biased so as to spend a disproportionate amount of time within the time scale 206 at the baseline frequency 202. The switch may actuate every 5-10 droplets 107.

Once the modulation function is obtained by the microdroplet adjustment module 404, the feed forward module 406 transmits the obtained modulation function to the source laser 101. The source laser 101 can then use the modulation function to adjust the rate at which laser pulses are generated so that the pulses hit the formed droplets 107 at the irradiation site 105. Errors occurring during operation may be corrected with fast feedback timing corrections.

The evaluation module 208 receives and processes information collected from the plasma chamber 110 by the sensor 112. The information collected by the sensor 112 may indicate, for example, a measured droplet frequency or a measured EUV power generated by the laser pulses hitting the droplets 107. Based on this information, the evaluation module 208 may direct the modulation module 202 or the source laser 101 to adjust the modulation function, the dose control, or the laser pulse generation, respectively, such that the laser pulse 102 hits the droplets 107 at the irradiation site 105 and provides a constant average energy over the dose window.

Microdroplets that coalesce into the droplets 107 are spewed from the nozzle 412. A piezoelectric transducer (PZT) 410 controls the respective sizes of the microdroplets spewed by the nozzle 412. As explained elsewhere herein, the PZT 410 controls microdroplet generation according to a function where the frequency of the function dictates the velocity of the spewed microdroplets. The velocity of the microdroplets controls the rate at which they coalesce into droplets 107 and travel to the irradiation site 105. In some instances, a period at which an electrical signal applied to the PZT is oscillated creates the velocity difference, resulting in the modulated frequency of the coalesced droplets. This further dictates the frequency and velocity at which the coalesced droplets 107 arrive at the irradiation site 105.

Figure 5:
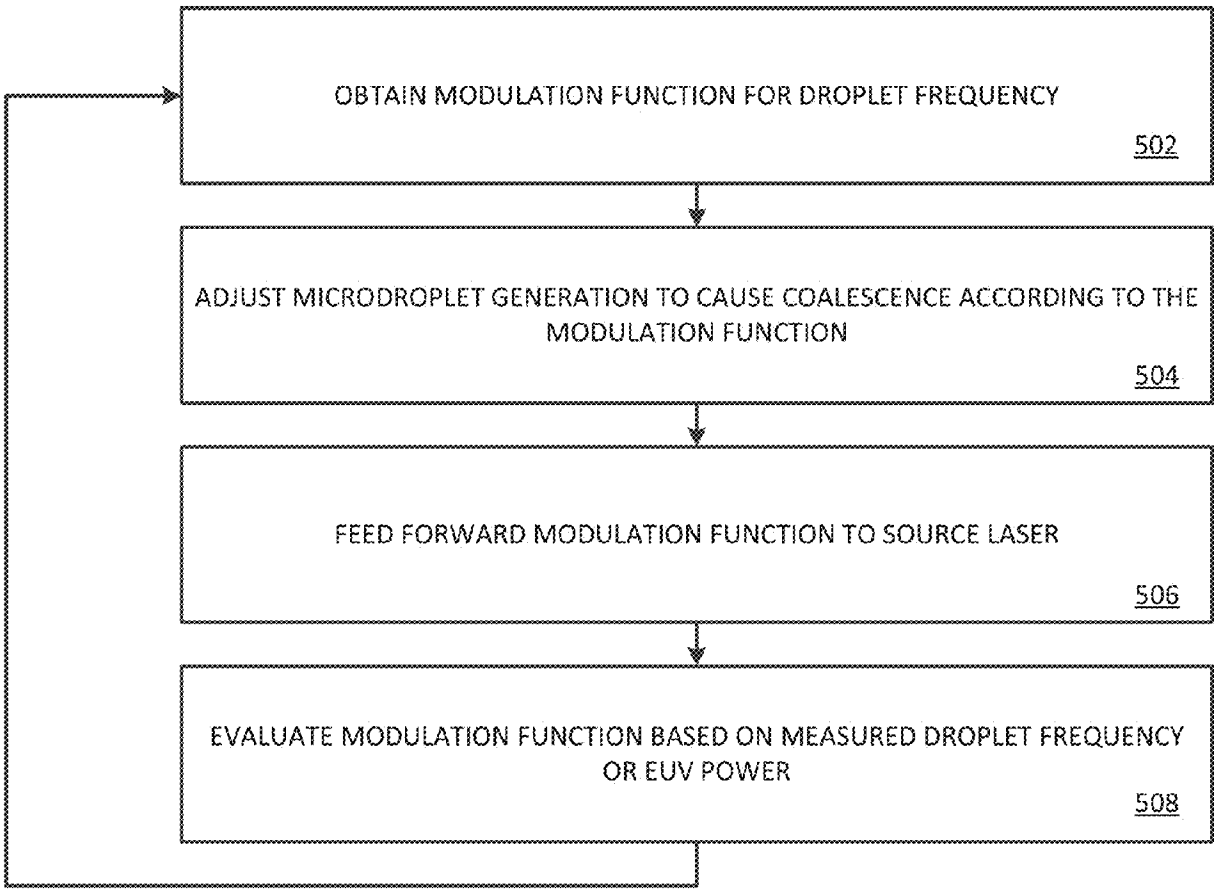
FIG. 5 is a flowchart describing a series of operations performed to generate droplets.

FIG. 5 is a flowchart describing a series of operations performed to generate droplets 107 and to direct timing of the source laser 101. The operations may be performed by the droplet controller 111 and the droplet generator 106.

In an operation 502, the modulation function having the zero-mean modulation is obtained. In some instances, the modulation function is obtained by the microdroplet adjustment module 404. In one embodiment, the modulation function is generated by and stored at the modulation module 402.

In an operation 504, the generation of the microdroplets is adjusted to cause droplet coalescence to occur according to the modulation function. For example, the microdroplets can be generated by the droplet generator 106 that operates according to a pulse wave function of varying frequency. In other instances, the droplet generator 106 can be operated according to the synthesized signal of multiple (e.g., three) sine waves. The adjustment may be calculated from the modulation function by, for example, the droplet controller 111.

In an operation 506, the modulation function is fed forward to the source laser 101 by, for example, the feed forward module 406. By feeding forward the modulation function, the source laser 101 is able to synchronize the generated laser pulses to the arrival of the droplets 107 at the irradiation site 105 or to compensate the dose.

In an operation 508, the modulation function is evaluated based on information collected from the plasma chamber 110. The information may include the measured droplet frequency or measured EUV power. Based on the evaluation, the modulation function can be adjusted by the droplet controller 111 as explained elsewhere herein.

While the oscillations in energy described herein are discussed as being due to variations in droplet time-of-flight from the droplet generator 106 to the irradiation site 105 within a plasma chamber 110, it is to be understood that the oscillations may be caused by other variables. As would be understood by one of skill in the art in light of the teachings herein, these variables can be intrinsic or exogenous to the processes occurring in the LPP EUV system 100. Examples of these variables can include, but are not limited to, disturbances of flow within the plasma chamber 110 from a cone or a perimeter of the collector 108, a pressure within the plasma chamber 110 (where the plasma chamber 110 is not a perfect vacuum), and/or a length of a protection shroud.

The disclosed method and apparatus has been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above. For example, different algorithms and/or logic circuits, perhaps more complex than those described herein, may be used, as well as possibly different types of source lasers and/or droplet generators.

Further, it should also be appreciated that the described method and apparatus can be implemented in numerous ways, including as a process, an apparatus, or a system. The methods described herein may be implemented by program instructions for instructing a processor to perform such methods, and such instructions recorded on a computer readable storage medium such as a hard disk drive, floppy disk, optical disc such as a compact disc (CD) or digital versatile disc (DVD), flash memory, etc., or over a computer network wherein the program instructions are sent over optical or electronic communication links. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A system for use with a laser produced plasma (LPP) extreme ultraviolet (EUV) system having a plasma chamber and an irradiation site within the plasma chamber, comprising:

a droplet controller configured to adjust, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at the irradiation site; and a droplet generator configured to generate the microdroplets according to the adjusted frequency of the microdroplet generation function.

2. The system of claim 1, wherein the droplet controller comprises a modulation module configured to store the modulation function.

3. The system of claim 1, wherein the droplet controller comprises a modulation module configured to generate the modulation function.

4. The system of claim 1, wherein the modulation function is a sinusoid or a combination of sinusoids.

5. The system of claim 1, wherein the modulation function is a randomly-timed, fixed-amplitude perturbation implemented as a pseudo-random switch.

6. The system of claim 1, wherein the modulation function minimizes oscillations in generated EUV energy at an oscillation frequency.

7. The system of claim 1, wherein the pre-defined droplet frequency is based on a desired EUV power.

8. The system of claim 1, wherein the modulation function has a modulation frequency within a defined tunable range.

9. The system of claim 1, wherein the modulation function has a zero-mean over the specified time scale, the zero mean calculated as an average amplitude value of the modulation function over the specified time scale.

10. The system of claim 1, wherein the LPP EUV system includes a sensor for measuring EUV energy generated in the plasma chamber and the specified time scale has a shorter duration than a dose window during which a moving average of the generated EUV energy is measured.

11. The system of claim 1, wherein the droplet controller comprises a feed forward module configured to transmit the modulation function to a source laser.

12. The system of claim 1, wherein the droplet controller comprises an evaluation module configured to evaluate the modulation function based on a measured droplet frequency or measured EUV power.

13. The system of claim 1 wherein the droplet controller comprises a feed forward module configured to transmit the modulation function to a source laser in the LPP EUV system so that the rate at which laser pulses are generated may be adjusted to synchronize the pulses to the arrival of the droplets at the irradiation site.

14. A method for use with a laser produced plasma (LPP) extreme ultraviolet (EUV) system having a plasma chamber, an irradiation site within the plasma chamber, and a droplet generator, comprising:

adjusting, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at the irradiation site; and generating the microdroplets by the droplet generator according to the adjusted amplitude of the microdroplet generation function.

15. The method of claim 14, further comprising generating the modulation function.

16. The method of claim 14, wherein the modulation function is a sinusoid.

17. The method of claim 14, wherein the modulation function is a randomly-timed, fixed-amplitude perturbation or a zero-mean random perturbation.

18. The method of claim 14, further comprising transmitting the modulation function to a source laser so that the rate at which laser pulses are generated may be adjusted to synchronize the pulses to the arrival of the droplets at the irradiation site.

19. The method of claim 14, further comprising evaluating the modulation function based on a measured droplet frequency or measured EUV power.

20. A non-transitory computer-readable medium having instructions embodied thereon for causing a computing device to execute a method for causing a droplet generator to generate droplets for use with a laser produced plasma (LPP) extreme ultraviolet (EUV) system having a plasma chamber and an irradiation site within the plasma chamber, the method comprising:

adjusting, according to a modulation function of a pre-defined droplet frequency over a specified time scale, a frequency of a microdroplet generation function for generating microdroplets that coalesce into droplets, the adjusted frequency dictating modulation of the pre-defined droplet frequency at which the droplets arrive at an irradiation site within a laser produced plasma (LPP) extreme ultraviolet (EUV) source plasma chamber; and generating the microdroplets by the droplet generator according to the adjusted frequency of the microdroplet generation function.

* * * * *